US007047582B2

(12) United States Patent
Moe et al.

(10) Patent No.: US 7,047,582 B2
(45) Date of Patent: May 23, 2006

(54) STAIN REMOVAL METHODS AND PRODUCTS ASSOCIATED THEREWITH

(75) Inventors: Kevin David Moe, West Chester, OH (US); Shellie Jean Caudill, Hamilton, OH (US); Janice Quintana Sadlowski, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 430 days.

(21) Appl. No.: 10/100,787

(22) Filed: Mar. 19, 2002

(65) Prior Publication Data

US 2003/0028974 A1 Feb. 13, 2003

Related U.S. Application Data

(60) Provisional application No. 60/277,032, filed on Mar. 19, 2001.

(51) Int. Cl.
*D06B 3/10* (2006.01)

(52) U.S. Cl. ..... 8/148; 8/158; 68/235 R

(58) Field of Classification Search ..... 8/148, 8/150, 158; 68/213, 235 R
See application file for complete search history.

(56) References Cited

U.S. PATENT DOCUMENTS

| | | | | |
|---|---|---|---|---|
| 2,552,853 | A * | 5/1951 | Isserstedt | 68/213 |
| 3,062,689 | A * | 11/1962 | Nakamura | 134/6 |
| 3,161,460 | A * | 12/1964 | Huber | 8/142 |
| 5,765,407 | A * | 6/1998 | Choo et al. | 68/214 |
| 5,840,675 | A * | 11/1998 | Yeazell | 510/417 |
| 5,849,039 | A * | 12/1998 | Sadlowski | 8/137 |
| 5,863,299 | A * | 1/1999 | Holt et al. | 8/142 |
| 5,865,851 | A * | 2/1999 | Sidoti et al. | 8/142 |
| 5,908,473 | A * | 6/1999 | Weller et al. | 8/142 |
| 6,048,368 | A * | 4/2000 | Tcheou et al. | 8/137 |
| 6,233,771 | B1 * | 5/2001 | Hortel et al. | 8/150 |
| 6,514,924 | B1 * | 2/2003 | Van Hauwermeiren et al. | 510/284 |

FOREIGN PATENT DOCUMENTS

JP 3-27171 * 2/1991

* cited by examiner

*Primary Examiner*—Frankie L. Stinson
(74) *Attorney, Agent, or Firm*—Mark A. Charles; C. Brant Cook; Steven W. Miller

(57) ABSTRACT

The present invention relates to stain removal methods and products associated therewith. The methods of the present invention are especially useful as part of a dry cleaning operation, but can also be used under any circumstances where stain removal from articles, especially fabrics, is desired.

21 Claims, 1 Drawing Sheet

STAIN REMOVAL METHODS AND PRODUCTS ASSOCIATED THEREWITH

RELATED APPLICATIONS

This application claims priority under 35 U.S.C. §119(e) to U.S. Provisional Application Ser. No. 60/277,032 filed Mar. 19, 2001.

FIELD OF THE INVENTION

The present invention relates to stain removal methods and products associated therewith. The methods of the present invention are especially useful as part of a dry cleaning operation, but can also be used under any circumstances where stain removal from articles, especially fabrics, is desired.

BACKGROUND OF THE INVENTION

Fabrics are often "spot treated" in localized areas to eliminate stains which are judged to be particularly persistent and difficult to remove. Such stain removal processes typically employ various liquids, gel or semi-solid spot remover compositions. In general, the process involves applying the spot remover to the stained area and vigorously rubbing, brushing, or blotting the area until the stain is judged to be satisfactorily removed. The ease-of-removal for any stain can depend on its chemical composition, the amount of the stain and the type of fabric. Fabrics in general, such as cotton, rayon, silk, wool, linen, polyester and the like, hold onto stains very tenaciously. Cotton is composed of loosely bound fiber bundles which are extremely porous in nature and prone to swelling and stretching of the weave. Cotton also exhibits a "fuzzy" fabric surface where a multitude of individual fibrils are loosely splayed just above the fabric surface. As the number of loose fibrils is increased, e.g., by mechanical abrasion, so does the level of light scattering across the fabric surface, thereby creating the illusion of excessive garment wear and/or fading.

As is well known, heavily stained garments may be "pre-spotted" using so-called "spot/stain removal" compositions prior to cleaning.

Conventional stain removal processes provide sub-optimal stain removing benefits due to the wicking of the stain throughout the area of the article in proximity to the stained area. Such wicking oftentimes results in rings and/or other residue on the article after completion of the stain removal operation and drying of the article.

Accordingly, there is a need for a stain removal method that provides effective stain removal without the wicking effects.

SUMMARY OF THE INVENTION

The present invention fulfills the needs identified above by providing methods for removing stains from a stained area of an article, preferably a fabric, without the negative wicking effects.

It has been surprisingly found that the stain removing methods of the present invention avoid the unsightly problems (i.e., rings and/or residue) associated with conventional stain removing methods.

It has been surprisingly found that by contacting the stain article, preferably adjacent to and/or on a peripheral edge of the stained area, with a first amount of stain removal composition and applying a mechanical action, such as rubbing and/or erasing the stained area, for example using the motion of erasing pencil marks with a pencil eraser, the stained area is inhibited from wicking to parts of the article through the first amount of stain removal composition.

In one aspect of the present invention, a method for removing stains from a stained area of an article comprising the steps of:

A) applying a first amount of a stain removal composition to the article adjacent to the stained area; and B) applying a second amount of a stain removal composition to the stained area; and C) optionally, concurrently or consecutively with Step B, contacting the stained area with a mechanical action, preferably wherein the mechanical action comprises a mechanical action in the direction of the first amount of the stain removal composition, such that the stained area is removed and/or reduced, wherein Step C occurs after Steps A and B, is provided.

In another aspect of the present invention, a method for removing stains from a stained area of an article comprising the sequential steps of:

A) applying a stain removal composition to the article in a manner such that at least a first portion of the stain removal composition is adjacent to the stained area and at least a second portion of the stain removal composition is in contact with the stained area; and B) optionally, subsequently applying a mechanical action, preferably wherein the mechanical action comprises a mechanical action in the direction of the first portion of the stain removal composition, to the second portion of the stain removal composition in contact with the stained area of the article such that the stained area is removed and/or reduced, is provided.

In still another aspect of the present invention, a method for removing stains from a stained area of an article comprising the steps of:

A) applying a stain removal composition to the stained area of the article such that at least a first portion of the stain removal composition is in contact with one or more of the peripheral edges of the stained area;

B) optionally, concurrently or consecutively with Step A, contacting the stained area of the article with a mechanical action, preferably wherein the mechanical action comprises a mechanical action in the direction of the first portion of the stain removal composition, such that the stained area is removed and/or reduced, is provided.

In yet another aspect of the present invention, an overall dry cleaning process for treating an entire area of a fabric surface, wherein the process comprises the overall steps of:

(i) conducting a stain removal process according to the present invention, on localized stained areas of fabric;

(ii) placing the entire fabric from step (i) together with a carrier containing an aqueous cleaning composition in a containment bag;

(iii) placing the bag in a device, preferably a hot air clothes dryer, to provide agitation and agitating said bag; and (iv) removing the fabric from the bag, is provided.

In even yet another aspect of the present invention, an overall dry cleaning process for treating an entire area of a fabric surface, wherein the process comprises the overall steps of:

(i) conducting a stain removal process according to the present invention, on localized stained areas of fabric;

(ii) placing the entire fabric from step (i) together with a carrier containing an aqueous cleaning composition into a device, preferably a hot air clothes dryer, to provide agitation and agitating said fabric; and (iv) removing the fabric from the device, is provided.

In still yet another aspect of the present invention, an overall laundering process for fabrics wherein the process comprises the overall steps of:

(i) conducting a stain removal process according to the present invention on localized stained areas of the fabric; and (ii) laundering the entire fabric from step (i) in a conventional aqueous laundering process, is provided.

In even still yet another aspect of the present invention, an overall stain removal process for removing stains from fabrics comprises the overall steps of:

(i) conducting a stain removal process according to the present invention on localized stained areas of the fabric; and (ii) drying the fabric, such as by air drying and/or by placing the fabric in a device, preferably a hot air clothes dryer, to provide agitation and agitating said fabric to dry the fabric, is provided.

In even yet another aspect of the present invention, a product comprising a stain removal composition, said product further comprising instructions for contacting a stained area of an article with the stain removal composition wherein the instructions comprise the steps of:

A) applying a first amount of the stain removal composition to the article adjacent to the stained area;

B) applying a second amount of the stain removal composition to the stained area;

C) optionally, concurrently or consecutively with Step B, contacting the stained area with a mechanical action, wherein the mechanical action preferably comprises a mechanical action in the direction of the first amount of stain removal composition, such that the stained area is removed and/or reduced, wherein Step C occurs after Steps A and B, is provided.

In still yet another aspect of the present invention, a product comprising a stain removal composition, said product further comprising instructions for contacting a stained area of an article with the stain removal composition wherein the instructions comprise the steps of:

A) applying the stain removal composition to the article in a manner such that at least a first portion of the stain removal composition is adjacent to the stained area and at least a second portion of the stain removal composition is in contact with the stained area; and B) optionally, subsequently applying a mechanical action, wherein the mechanical action preferably comprises a mechanical action in the direction of the first portion of the stain removal composition, to the second portion of the stain removal composition in contact with the stained area of the article such that the stained area is removed and/or reduced, is provided.

In even still yet another aspect of the present invention, a product comprising a stain removal composition, said product further comprising instructions for contacting a stained area of an article with the stain removal composition wherein the instructions comprise the steps of:

A) applying a stain removal composition to the stained area of the article such that at least a first portion of the stain removal composition is in contact with one or more of the peripheral edges of the stained area;

B) optionally, concurrently or consecutively with Step A, contacting the stained area of the article with a mechanical action, wherein the mechanical action preferably comprises a mechanical action in the direction of the first portion of the stain removal composition, by means of a cleaning device such that the stained area is removed and/or reduced, is provided.

In another aspect of the present invention, a kit comprising a) a stain removal composition;

b) instructions for using the stain removal composition to remove stains from an article, preferably a fabric article; and c) optionally, a practice stain which comprises a practice article comprising a stain upon which a user can practice the instructions for using the stain removal composition; and d) optionally, an absorbent stain receiver article; and e) optionally, a liquid cleaning/refreshment composition, preferably releasably contained in a carrier sheet; and f) optionally, a containment bag.

Accordingly, the present invention provides methods for removing stains from articles that avoids negative wicking effects, and products and kits comprising instructions for removing stains.

DETAILED DESCRIPTION OF THE INVENTION

Method for Removing a Stain

Figure 1A:
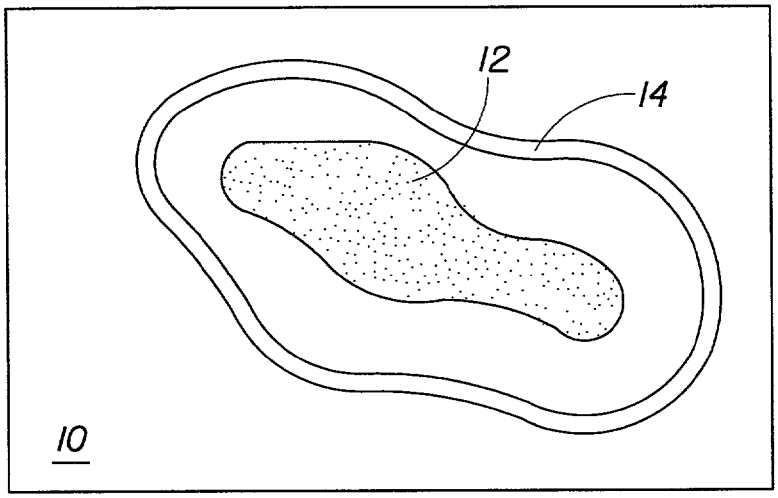
FIGS. 1A, 1B and 1C is a schematic illustrating a preferred stain removal method of the present invention.

FIG. 1A illustrates the step of contacting an article 10 comprising a stained area 12 with a stain removal composition 14, by preferably contacting the article 10 adjacent to and/or on a peripheral edge of the stained area 12.

Figure 1B:
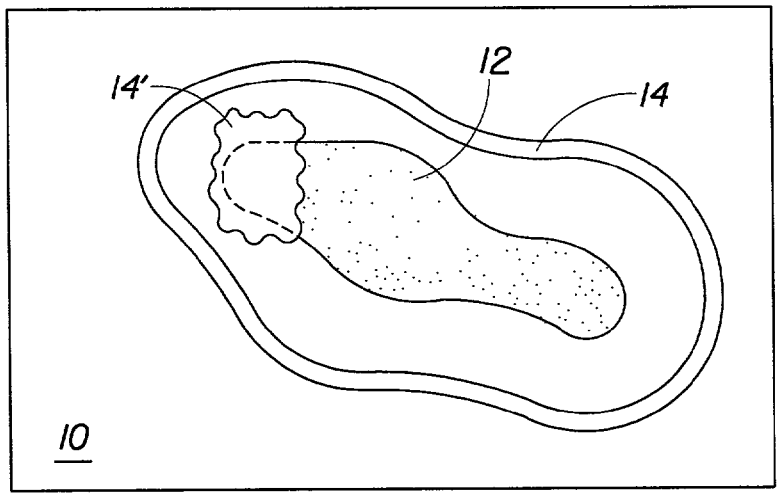

FIG. 1B illustrates the step of contacting the stained area 12 of the article 10 with a stain removal composition 14'.

Figure 1C:
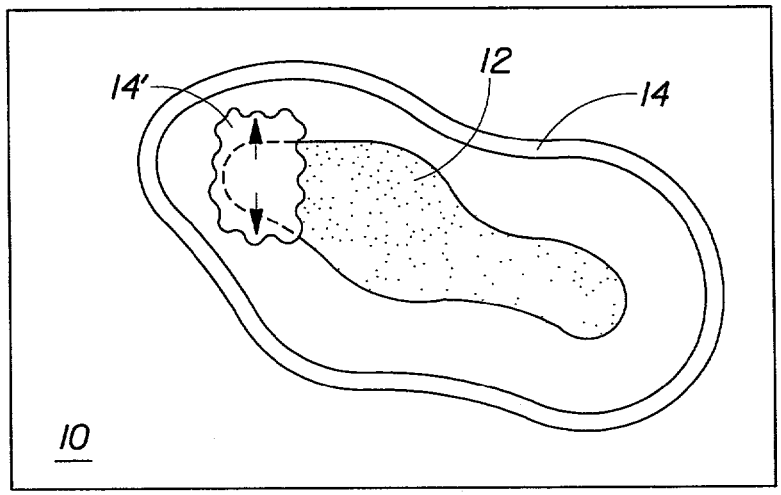

FIG. 1C illustrates the step of applying a mechanical action to the stain removal composition 14' present on the stained area 12 of the article 10. The arrows illustrate the preferred direction of the mechanical action, preferably in the direction of the stain removal composition 14.

The steps illustrated in 1A, 1B and 1C may occur sequentially or simultaneously. The essential step to protect against the wicking effects associated with stain removal is the step illustrated in 1A. Preferably the step illustrated in FIG. 1 A occurs prior to the step in FIGS. 1B and 1C.

In one embodiment, the method according to the present invention comprises applying the first amount of the stain removal composition to the article adjacent to the stained area such that the first amount substantially circumscribes the stained area.

In another embodiment, the method according to the present invention comprises applying the first amount of the stain removal composition to the article adjacent to the stained area such that the first amount circumscribes the stained area.

The mechanical action step can be performed by any suitable means known to those of ordinary skill in the art. Preferably the mechanical action is applied by using a cleaning device, such as a dispenser tip of a bottle containing the stain removal composition. The dispenser tip maybe concave, convex or flat.

In a preferred embodiment, the stained area of the article is placed on top of a rigid surface and/or an absorbent stain receiver article to facilitate the mechanical action step if any.

Stain Removal Composition

Any suitable stain removal composition may be used with the methods of the present invention. Stain removal compositions vary depending upon the type of stain to be removed and/or the article upon which the stain resides. The stain removal composition may be a non-aqueous composition or an aqueous composition.

Nonlimiting examples of stain remover systems are described in U.S. Pat. Nos. 5,891,197, 5,872,090, 5,849,039, 5,789,368 and 5,681,355 and U.S. patent application Ser. No. 60/190,640. Typically the stain remover system comprises a stain removal composition as well as an absorbent stain receiver article.

A preferred fabric stain removal composition comprises an amine oxide and/or a diamine as described below.

a. Amine Oxides

The stain removal composition may comprise a tertiary amine oxide having the formula:

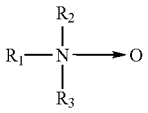

wherein $R_1$ is a $C_{10}$–$C_{25}$ linear or branched alkyl group, and $R_2$ and $R_3$ are independently selected from $C_1$–$C_4$ alkyl groups and $C_2$–$C_4$ hydroxy alkyl groups; from about 0.01% to about 5% by weight of the composition of a surfactant selected from the group consisting of anionic surfactants, nonionic surfactant, cationic surfactants, zwitterionic surfactants and mixtures thereof, preferably an alkyl sulfate anionic surfactant or alkyl ether carboxylates; and the balance detergent adjunct ingredients; wherein the molar ratio of amine oxide to total surfactant is from about 5:4 to about 9:1 and the composition is substantially free of halide bleaching agents.

b. Diamines

The stain removal composition may comprise a diamine, preferably an organic diamine. If a diamine is present in the compositions of the present invention, it is preferably present at a level of from about 0.25% to about 15%, more preferably from about 0.30% to about 5%, most preferably from about 0.30% to about 2% by weight of the composition.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25.degree. C. and for an ionic strength between 0.1 to 0.5M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., JEFFAMINE EDR 148®, (namely 1,2-bis(2-aminoethoxy)ethane). In addition, materials based on ethylene diamine are unsuitable.

The diamines useful herein can be defined by the following structure:

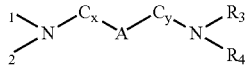

wherein $R_{1-4}$ are independently selected from H, methyl, ethyl, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must be 1 or greater, preferably 2 or greater.

Examples of preferred diamines include the following:

Dimethyl aminopropyl amine

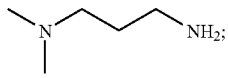

1,6-Hexane diamine

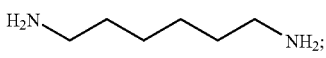

-continued

| | |
|---|---|
| 1,3-Propane diamine | $H_2N$ ⟨ $NH_2$; |
| 2-Methyl 1,5-pentane diamine | $H_2N$ ⟨ $NH_2$; |
| 1,3-Pentadiamine, available under the tradename DYTEK EP | $H_2N$ ⟨ $NH_2$ ; |
| 1-Methyl-diaminopropane or 1,3-Diaminobutane | $H_2N$ ⟨ $NH_2$; |
| JEFFAMINE EDR 148 ®, (1,2-bis(2-aminoethoxy)ethane) | $H_2N$ ⟨ O ⟨ O ⟨ $NH_2$; |
| Isophorone diamine | $NH_2$ ⟨ $CH_2CH_2NH_2$; |
| 1,3-bis(methylamine)-cyclohexane or 1,3-cyclohexanebis(methylamine) | $CH_2NH_2$ ⟨ $CH_2NH_2$ |

and mixtures thereof.

Products

Products in accordance with the present invention comprise a stain removal composition and instructions for contacting a stained area of an article with the stain removal composition wherein the instructions comprise the steps of:

A) applying a first amount of the stain removal composition to the article adjacent to the stained area;

B) applying a second amount of the stain removal composition to the stained area;

C) optionally, concurrently or consecutively with Step B, contacting the stained area with a mechanical action, wherein the mechanical action preferably comprises a mechanical action in the direction of the first amount of stain removal composition, by a means of a cleaning device such that the stained area is removed and/or reduced, wherein Step C occurs after Steps A and B, is provided.

Alternatively, products in accordance with the present invention comprise a stain removal composition and instructions for contacting a stained area of an article with the stain removal composition wherein the instructions comprise the steps of:

A) applying the stain removal composition to the article in a manner such that at least a first portion of the stain removal composition is adjacent to the stained area and at least a second portion of the stain removal composition is in contact with the stained area; and B) optionally, subsequently applying a mechanical action, wherein the mechanical action preferably comprises a mechanical action in the direction of the first portion of the stain removal composition, to the second portion of the stain removal composition in contact with the stained area of the article such that the stained area is removed and/or reduced, is provided.

In another embodiment, products in accordance with the present invention comprise a stain removal composition and instructions for contacting a stained area of an article with the stain removal composition wherein the instructions comprise the steps of:

A) applying a stain removal composition to the stained area of the article such that at least a first portion of the stain removal composition is in contact with one or more of the peripheral edges of the stained area;

B) optionally, concurrently or consecutively with Step A, contacting the stained area of the article with a mechanical action, wherein the mechanical action preferably comprises a mechanical action in the direction of the first portion of the stain removal composition, by means of a cleaning device such that the stained area is removed and/or reduced, is provided.

The stain removal compositions of the products of the present invention may be packaged in any suitable package, such as bottles, especially bottles with a tip suitable for providing mechanical action to the stain removal composition present on a stained area of an article.

Kits

The products of the present invention (stain removal composition plus instructions for using) may be incorporated into kits in accordance with the present invention.

The kits in accordance with the present invention comprise:

a) a stain removal composition;

b) instructions for using the stain removal composition to remove stains from an article, preferably a fabric article; and c) optionally, a practice stain which comprises a practice article comprising a stain upon which a user can practice the instructions for using the stain removal composition; and d) optionally, an absorbent stain receiver article; and e) optionally, a liquid cleaning/refreshment composition, preferably releasably contained in a carrier sheet; and f) optionally, a containment bag.

In a preferred embodiment, a kit in accordance with the present invention comprises a stain removal composition and instructions for removing stains and a containment bag, preferably a reusable containment bag, more preferably a fabric reusable containment bag. Nonlimiting examples of such containment bags are described in U.S. Pat. Nos. 5,789,368 and 5,681,355 and U.S. patent application Ser. No. 60/190,640 and PCT Publication No. WO 00/37733.

Cleaning/Refreshment Composition

The kits of the present invention preferably comprise a cleaning/refreshment composition preferably releasably absorbed in a carrier sheet. The carrier sheet preferably comprises a differential elongation composite material. By "releasably contains" it is meant that the composition is effectively released from the carrier sheet onto an article, preferably soiled fabrics as part of a non-immersion cleaning and fabric refreshment process as described herein. This release occurs mainly by volatilization of the composition from the carrier sheet.

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. and in U.S. Pat. No. 5,591,236, which issued on Jan. 7, 1997 to Roetker. The entire disclosure of the You et al. and the Roetker patents are incorporated herein by reference. Additionally, cleaning/refreshment compositions are described in co-pending U.S. patent application Ser. No. 08/789,171, which was filed on Jan. 4, 1997, in the name of Trinh et al. The entire disclosure of the Trinh et al. Application is incorporated herein by reference.

It is especially preferred that the cleaning/refreshment compositions of this invention include a shrinkage reducing composition, which is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

In addition to the above ingredients, the cleaning/refreshment composition may optionally comprise a bleaching agent, preferably hydrogen peroxide.

The following Examples further illustrate the invention, but are not intended to be limiting thereof.

EXAMPLE I

Cleaning/Refreshment Compositions

A. Fabric cleaning/refreshment compositions according to the present invention, for use in a containment bag, are prepared as follows:

| Ingredient | % (wt.) |
|---|---|
| Emulsifier (TWEEN 20)* | 0.5 |
| Soil redeposition inhibiting agent | 5.0 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

B. Additionally, preferred compositions for use in the in-dryer cleaning/refreshment step of the process herein are as follows.

| Ingredient | % (wt.) | Range (% wt.) |
|---|---|---|
| Water | 99.0 | 0.1–99.9 |
| Perfume | 0.5 | 0.05–1.5 |
| Surfactant | 0.5 | 0.05–2.0 |
| Ethanol or Isopropanol | 0 | Optional to 4% |
| Solvent (e.g. BPP) | 0 | Optional to 4% |
| pH range from about 6 to about 8. | | |

C. Additionally, preferred compositions for use in the in-dryer cleaning/refreshment step of the process herein are as follows:

| Ingredient | % (wt.) | % (wt.) | % (wt.) | % (wt.) |
|---|---|---|---|---|
| Water | 97.63 | 98.85 | 77.22 | 96.71 |
| Perfume | 0 | 0.38 | 0.38 | 0 |
| Surfactant | 0.285 | 0 | 0 | 0.285 |
| Solvent (e.g. BPP) | 2.0 | 0 | 0 | 2.0 |
| KATHON ® | 0.0003 | 0 | 0 | 0 |
| Emulsifier (TWEEN 20)* | 0 | 0.5 | 0.38 | 0 |
| Amine Oxide | 0.0350 | 0 | 0 | 0.0350 |
| $MgCl_2$ | 0.045 | 0 | 0 | 0 |
| $MgSO_4$ | 0 | 0 | 0.058 | 0 |
| Hydrogen Peroxide | 0 | 0 | 0 | 0.6 |
| Citric Acid | 0 | 0 | 0 | 0.05 |

-continued

| Ingredient | % (wt.) | % (wt.) | % (wt.) | % (wt.) |
|---|---|---|---|---|
| Proxel GXL | 0 | 0.08 | 0.08 | 0 |
| Bardac 2250 | 0 | 0.2 | 0.2 | 0 |
| 1,2-Propanediol | 0 | 0 | 21.75 | 0 |

*Polyoxyethylene (20) sorbitan monolaurate available from ICI Surfactants.

Besides the other ingredients, the foregoing compositions can contain enzymes to further enhance cleaning performance, as described in the Trinh et al. patent incorporated herein above.

Even though water is a component of the above-described cleaning/refreshment compositions, it can be absent from carrier sheet of the present invention, especially if water (moisture) is added into the fabric treating system in another manner, such as in a separate discrete sheet.

EXAMPLE II

A kit in accordance with the present invention comprises the following:

a. one or more bottles containing a stain removal composition, preferably having a formula:

| Ingredients | A | B | C | D | E | F |
|---|---|---|---|---|---|---|
| Alkyl sulfate | 0.050 | 0.050 | 0.050 | 0.035 | 0.035 | 0.035 |
| Amine Oxide | 0.45 | 0.45 | 0.45 | 0.285 | 0.285 | 0.285 |
| Citric Acid | 0.060 | 0.060 | 0.060 | 0.0375 | 0.0375 | 0.0375 |
| Diamine | 0.070 | 0.070 | 0.070 | 0.045 | 0.045 | 0.045 |
| BPP | 0.0 | 2.0 | 2.0 | 2.0 | 0.0 | 2.0 |
| Preservative | 0.0003 | 0.0 | 0.0003 | 0.0 | 0.0003 | 0.0003 |
| Water | to balance | to balance | to balance | to balance | to balance | to balance |

and instructions for using the stain removal composition to remove stains, b. optionally, a cleaning/refreshment composition; and c. optionally, one or more carrier sheets containing a cleaning/refreshment composition; and d. optionally, one or more containment bags, woven or non-woven, plastic or fabric, preferably fabric, venting or non-venting, preferably venting; and e. optionally, one or more absorbent stain receiver pads, preferably comprising TBAL, LBAL, MBAL or HIPE; and f. optionally, instructions for using any of a.–e. to treat a fabric substrate.

What is claimed is:

1. A method for removing stains from a stained area of an article comprising the steps of:

A) applying a first amount of a stain removal composition to the article adjacent to the stained area; and B) applying a second amount of a stain removal composition to the stained area; and C) optionally, concurrently or consecutively with Step B, contacting the stained area with a mechanical action by means of a cleaning device such that the stained area is removed and/or reduced, wherein Step C occurs after Steps A and B.

2. The method according to claim 1 wherein Step A comprises applying the first amount of the stain removal composition to the article adjacent to the stained area such that the first amount substantially circumscribes the stained area.

3. The method according to claim 1 wherein Step A comprises applying the first amount of the stain removal composition to the article adjacent to the stained area such that the first amount circumscribes the stained area.

4. The method according to claim 1 wherein Step A occurs prior to Step B.

5. The method according to claim 1 wherein the stain removal composition comprises a non-aqueous composition.

6. The method according to claim 1 wherein the stain removal composition comprises an aqueous composition.

7. The method according to claim 1 wherein the stain removal composition comprises butoxy propoxy propanol.

8. The method according to claim 1 wherein the stain removal composition comprises a peroxide source.

9. The method according to claim 1 wherein said cleaning device comprises a dispenser tip of a bottle containing the stain removal composition.

10. The method according to claim 1 wherein said dispenser tip is concave, convex or flat.

11. The method according to claim 1 wherein said method further comprises placing the stained area of the article over an absorbent stain receiver article such that the stain is transferred from the article to the absorbent stain receiver article.

12. The method according to claim 11 wherein said absorbent stain receiver article is a TBAL, LBAL or MBAL stain receiver article.

13. The method according to claim 11 wherein said absorbent stain receiver article is a FAM-foam stain receiver article.

14. An overall dry cleaning process for treating an entire area of a fabric surface comprising the overall steps of:

(i) conducting a stain removal process according to claim 1, on localized stained areas of the fabric surface;

(ii) placing the entire fabric from step (i) together with a carrier containing an aqueous cleaning composition in a containment bag;

(iii) placing the bag in a device to provide agitation and agitating said bag; and (iv) removing the fabric from the bag.

15. The process according to claim 14 wherein Step (iii) is conducted in a hot air clothes dryer.

16. An overall laundering process for fabrics comprising the overall steps of:

(i) conducting a stain removal process according to claim 1 on localized stained areas of the fabrics; and (ii) laundering the entire fabrics from step (i) in a conventional aqueous laundering process.

17. An overall dry cleaning process for treating an entire area of a fabric surface comprising the overall steps of:

(i) conducting a stain removal process according to claim 1, on localized stained areas of the fabric surface;

(ii) placing the entire fabric from step (i) together with a carrier containing an aqueous cleaning composition in a device to provide agitation and agitating said fabric; and (iii) removing the fabric from the device.

18. The process according to claim 17 wherein Step (ii) is conducted in a hot air clothes dryer.

19. An overall laundering process for fabrics comprising the overall steps of:

(i) conducting a stain removal process according to claim 1 on localized stained areas of the fabrics; and (ii) drying the fabrics.

20. The process according to claim 19 wherein the drying step occurs in a hot air clothes dryer.

21. A method for removing stains from a stained area of an article comprising the sequential steps of:

A) applying a stain removal composition to the article in a manner such that at least a first portion of the stain removal composition is adjacent to the stained area and at least a second portion of the stain removal composition is in contact with the stained area; and B) optionally, subsequently applying a mechanical action to the second portion of the stain removal composition in contact with the stained area of the article such that the stained area is removed and/or reduced.

* * * * *